US005409073A

United States Patent [19]

Gonzales

[11] Patent Number: 5,409,073

[45] **Date of Patent: * Apr. 25, 1995**

[54] ROTATING HEAD WITH ELASTOMERIC MEMBER ROTATING ASSEMBLY

[75] Inventor: Don E. Gonzales, Cordell, Okla.

[73] Assignee: The Sydco System, Cordell, Okla.

[ * ] Notice: The portion of the term of this patent subsequent to Aug. 11, 2009 has been disclaimed.

[21] Appl. No.: 202,307

[22] Filed: Feb. 25, 1994

Related U.S. Application Data

[63] Continuation of Ser. No. 965,111, Oct. 22, 1992, Pat. No. 5,322,137.

[51] Int. Cl.[6] ..... E21B 33/03

[52] U.S. Cl. ..... 175/195; 166/84; 277/31

[58] Field of Search ..... 166/84, 82; 175/195, 175/209; 277/3, 31; 285/16

[56] References Cited

U.S. PATENT DOCUMENTS

| | | | |
|---|---|---|---|
| 830,100 | 9/1906 | Post . | |
| 2,398,459 | 4/1946 | Province . | |
| 3,052,300 | 9/1962 | Hampton . | |
| 3,400,938 | 9/1968 | Williams . | |
| 3,724,862 | 4/1973 | Biffle | 277/31 |
| 3,965,987 | 6/1976 | Biffle | 166/84 X |
| 4,293,047 | 10/1981 | Young | 175/195 |
| 4,340,262 | 7/1982 | Rugh et al. | 308/187 |
| 4,345,769 | 8/1982 | Johnston | 277/31 |
| 4,363,357 | 12/1982 | Hunter | 166/84 |
| 4,423,776 | 1/1984 | Wagoner et al. | 166/84 |
| 4,480,843 | 11/1984 | Springer et al. | 277/31 |
| 4,486,025 | 12/1984 | Johnston | 277/31 |
| 4,526,243 | 7/1985 | Young | 175/195 |
| 4,531,591 | 7/1985 | Johnston | 175/57 |
| 4,560,001 | 12/1985 | Gonzales | 166/84 |
| 4,745,970 | 5/1988 | Bearden et al. | 166/84 |
| 5,137,084 | 8/1984 | Gonzales et al. | 166/84 |
| 5,322,137 | 6/1994 | Gonzales | 175/195 |

OTHER PUBLICATIONS

Pruitt Rotating Heads-Sales Brochure, 5 pages.
Williams Tool Co. Inc.-Sales Brochure, 2 pages.
Fugett Equipment Co.-Ad Sheet, 1 page.
Grant Oil Tool, Bulletin 86—Sales Brochure, 8 pages.
Exhibit A-Sketch, Undated, entitled "Adams Head".
Exhibit B-Drawing B "Adams Rotating Head With Drive . . . ".
Exhibit C-Drawing A "Head Rubber With Drive Built Into . . . ".

*Primary Examiner*—Hoang C. Dang
*Attorney, Agent, or Firm*—Dunlap & Codding

[57] ABSTRACT

A rotating head having a bowl assembly and a rotating assembly disposed in a bowl opening formed in the bowl assembly. The rotating assembly consists of an elastomeric member having a bearing wall formed thereon bearingly engaging a portion of the bowl assembly for bearingly supporting the elastomeric member in the bowl assembly. The elastomeric member sealingly engages a portion of the bowl assembly for forming a seal between the rotating assembly and the bowl assembly.

23 Claims, 5 Drawing Sheets

ROTATING HEAD WITH ELASTOMERIC MEMBER ROTATING ASSEMBLY

This is a continuation application of U.S. Ser. No. 07/965,111 filed on Oct. 22, 1992, entitled "ROTATING HEAD WITH ELASTOMERIC MEMBER ROTATING ASSEMBLY", now the U.S. Pat. No. 5,322,137.

FIELD OF THE INVENTION

The present invention generally relates to rotating heads and, more particularly, but not by way of limitation, to a rotating head with a rotating assembly consisting of an elastomeric member sealingly and bearingly supported on a bowl assembly.

BRIEF DESCRIPTION OF THE DRAWINGS

FIG. 5 is a top plan view of the rotating head with the upper housing plate removed.

DESCRIPTION OF THE PREFERRED EMBODIMENTS

Figure 1:
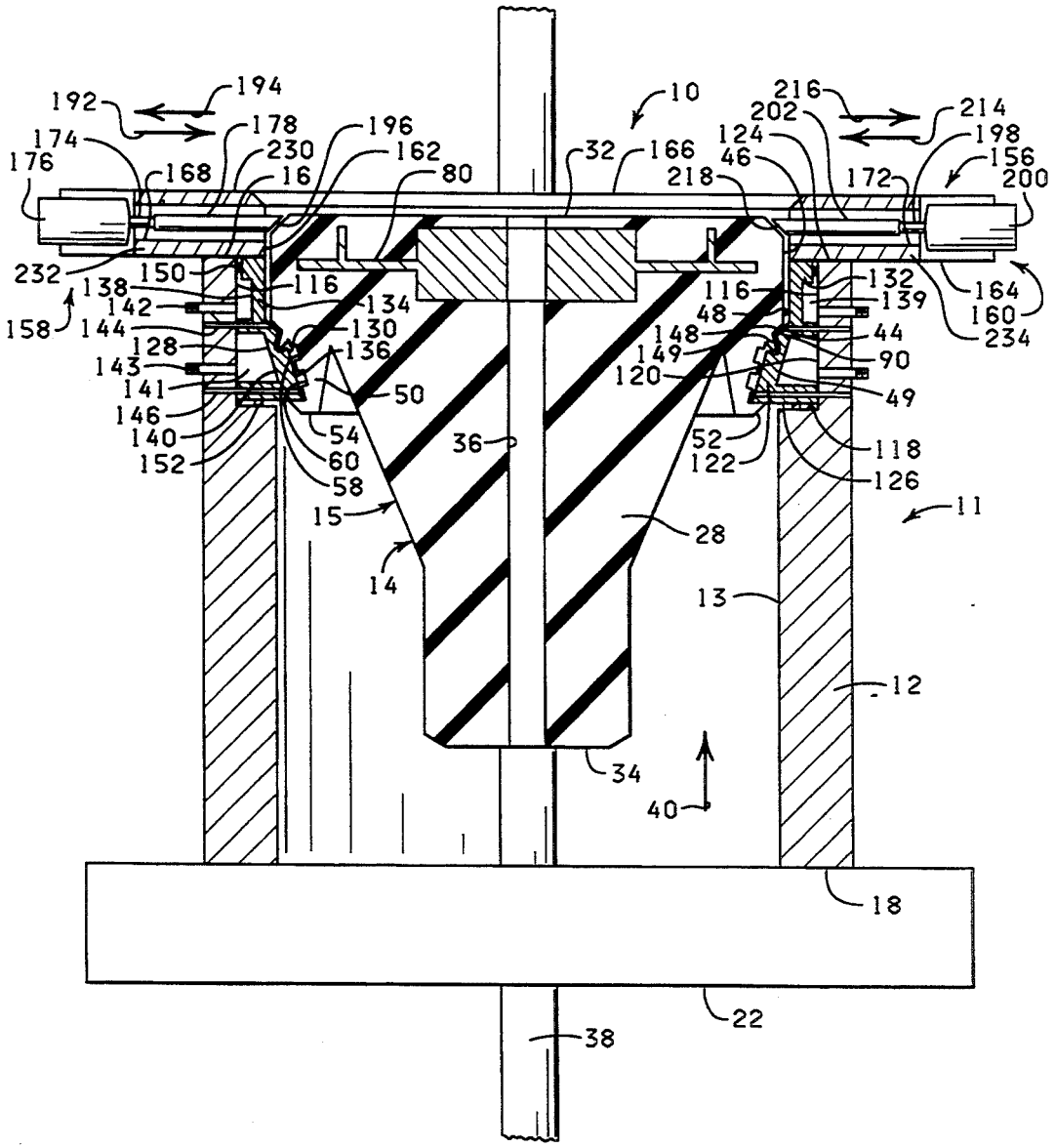
FIG. 1 is a sectional view of a rotating head constructed in accordance with the present invention.
Figure 2:
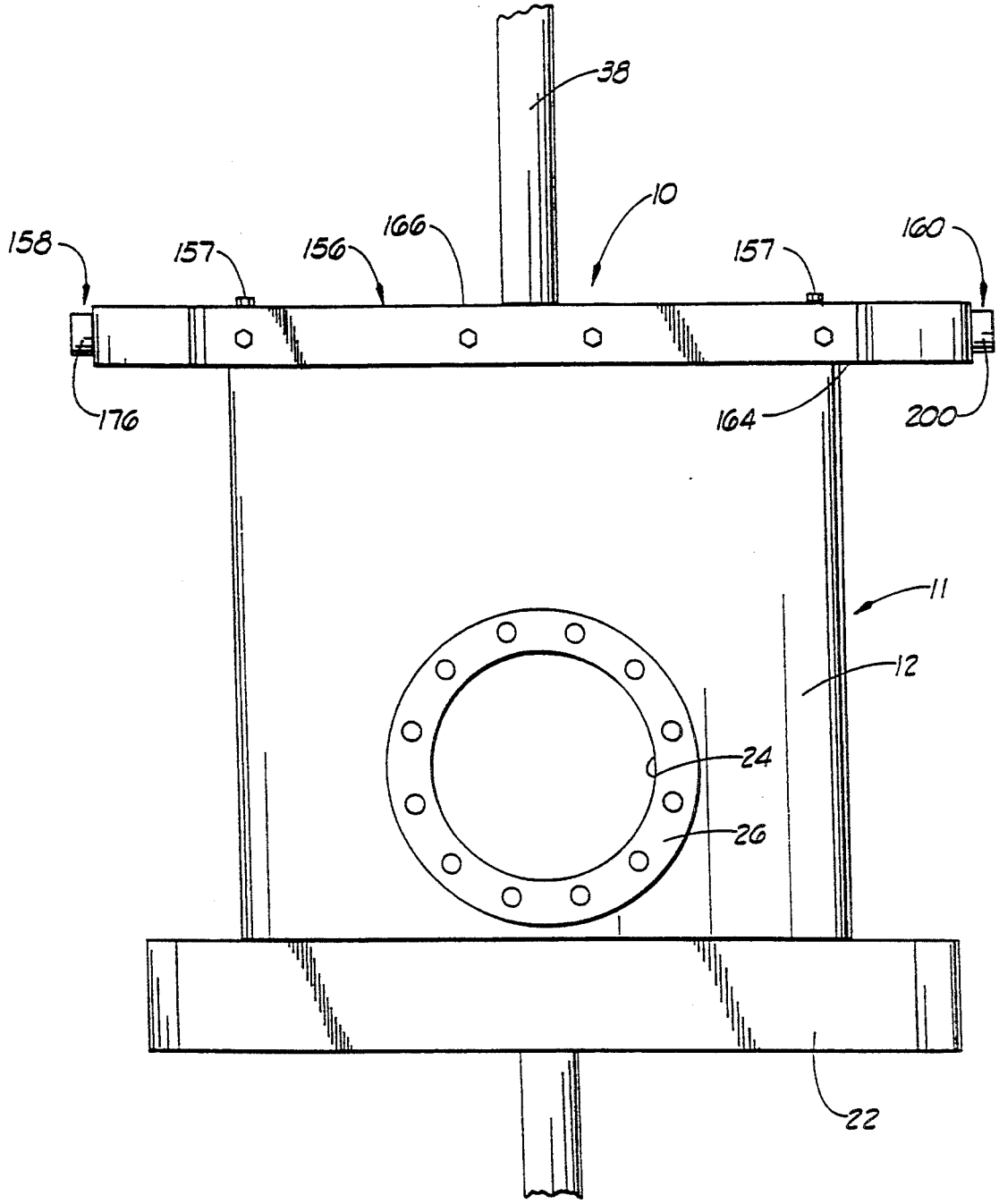
FIG. 2 is a side elevational view of the rotting head of FIG. 1.
Figure 3:
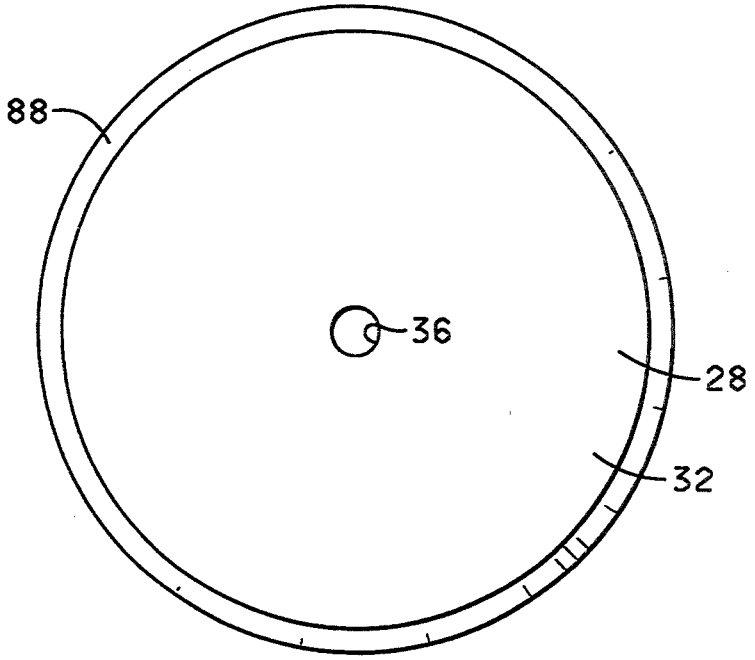
FIG. 3 is a top elevational view of the rotating assembly used in the rotating head of FIGS. 1 and 2.

Shown in FIGS. 1 and 2 is a rotating head 10 which is constructed in accordance with the present invention. The rotating head 10 basically comprises a bowl assembly 11 having a bowl opening 13 (FIG. 1) formed therein and a rotating assembly 14 (FIG. 1) having an elastomeric member outer peripheral surface 15 (FIG. 1) disposed in the bowl opening 13. The rotating assembly 14 is rotatingly disposed in the bowl opening.13 and portions of the rotating assembly 14 sealingly engage portions of the bowl assembly 11 and other portions of the rotating assembly 14 bearingly .engage portions of the bowl assembly 11 during the rotation of the rotating assembly 14 in the bowl assembly 11.

As shown in FIG. 1, the bowl assembly 11 comprises an outer bowl 12 having an upper end 16, a lower end 18. The bowl opening 13 more particularly extends through the outer bowl 12 intersecting the upper end 16 and the lower end 18 of the outer bowl 12.

A connecting flange 22 (FIGS. 1 and 2) is formed on the lower end 18 of the outer bowl 12. The connecting flange 22 extends a distance radially from outer bowl 12.

A discharge opening 24 (FIG. 2) is formed through the outer bowl 12 and positioned generally between the upper end 16 and the lower end 18 of the outer bowl 12. The discharge opening 24 intersects the bowl opening 13. A discharge flange 26 (FIG. 2) is formed on the outer bowl 12 encompassing the discharge opening 24.

The rotating assembly 14 consists solely of an elastomeric member 28 (FIGS. 1, 3, 4 and 5) the elastomeric member 28 is supported within the bowl assembly 11; and the elastomeric member 28 bearingly and sealingly engages the bowl assembly 11 during operation of the rotating assembly 14.

As shown in FIGS. 1, 3, 4 and 5, the elastomeric member 28 has an upper end 32 and a lower end 34. A circularly shaped drive opening 36 (FIGS. 3 and 5) is formed through the elastomeric member 28 intersecting the upper and the lower ends 32 and 34 thereof. The drive opening 36 is sized and shaped to receive a kelly or drill pipe 38 (FIGS. 1 and 2). The drill pipe 38 has a circularly shaped cross section and the drive opening 36 is slightly smaller than the diameter of the drill pipe 38 so that, when the drill pipe 38 is extended through the drive opening 36 a sealing and gripping engagement is formed between the elastomeric member 28 and the drill pipe 38.

It should be noted that the drill pipe 38 may have a square or multi-sided cross-section in some instances. In this event, the diameter of the drive opening 36 is smaller than the effective diameter of the drill pipe 38 so that the sealing and gripping engagement between the elastomeric member 28 and the drill pipe 38 still is formed.

During the drilling operations at an oil well, gas well or oil and gas well drilling site (well drilling site), the drill pipe or kelly 38 is extended into the well bore (not shown in the drawings) and drilling fluid is passed into the borehole. A plurality of blowout preventers (not shown in the drawings) are connected to the well borehole and the rotating head 10 is connected to the upper most blow-out preventer via the connecting flange 22. The drill pipe 38 extends through the rotating head 10 and through the blow-out preventers and into the well borehole. During the drilling operations, drilling fluid is passed from the well borehole, up through the blow-out preventers and up through the bowl opening 13 in a direction 40 (FIG. 1). The rotating head 10 is designed to divert the received drilling fluid out through the discharge opening 24 in a direction generally perpendicular to the direction 40 for passing the drilling fluid back to a fluid pit or pits (not shown) located at the well drilling site generally near the drilling operations. The drilling fluid commonly is referred to in the industry as drilling mud. The drill pipe 38 is rotated during the drilling operations. The elastomeric member 28 sealingly engages the drill pipe 38 to prevent the drilling fluid from being passed upwardly in the direction 40 through the rotating head 10 and onto the drilling platform floor or onto another portion of the drilling rig. The rotating head 10 functions to divert the received drilling fluid for passing the drilling fluid back to the mud pit or pits.

As the drill pipe 38 is rotated during the drilling operations, the rotating of the drill pipe 38 rotates the rotating assembly 14 due to the sealing and gripping engagement between the elastomeric member 28 and the drill pipe 38. As the rotating assembly 14 is rotated, the elastomeric member 28 bearingly engages a portion of the bowl assembly 11 for bearingly supported the rotating assembly 14 in the bowl opening 13. It is significant to note that the elastomeric member 28 provides the only bearing support for the rotating assembly 14 and the elastomeric member 28 also sealingly engages the bowl assembly 11 and the drill pipe 38.

Figure 4:
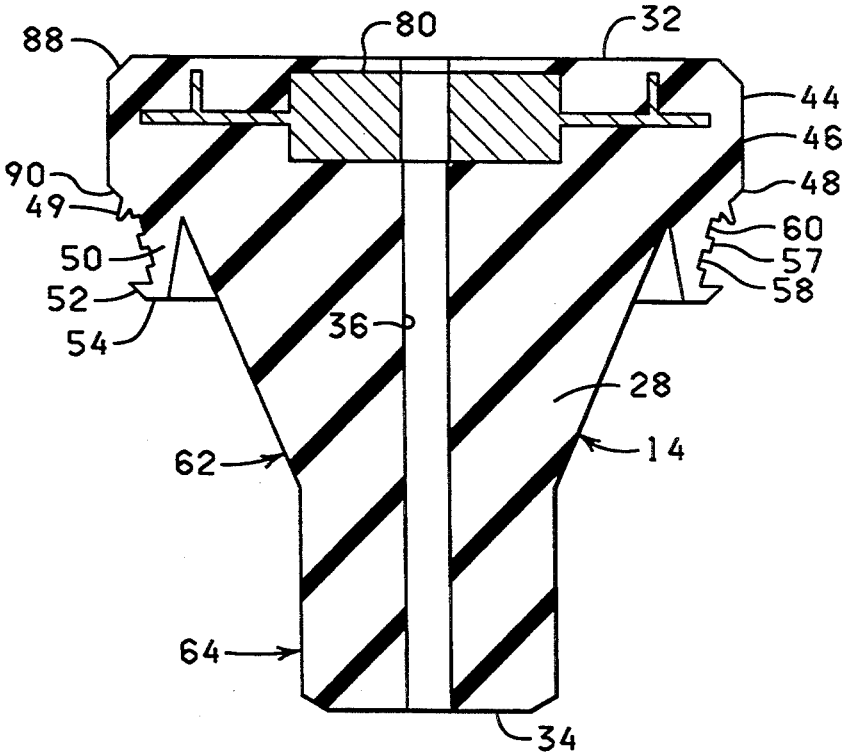
FIG. 4 is a side elevational view of the rotating assembly of FIG. 3.
Figure 3:
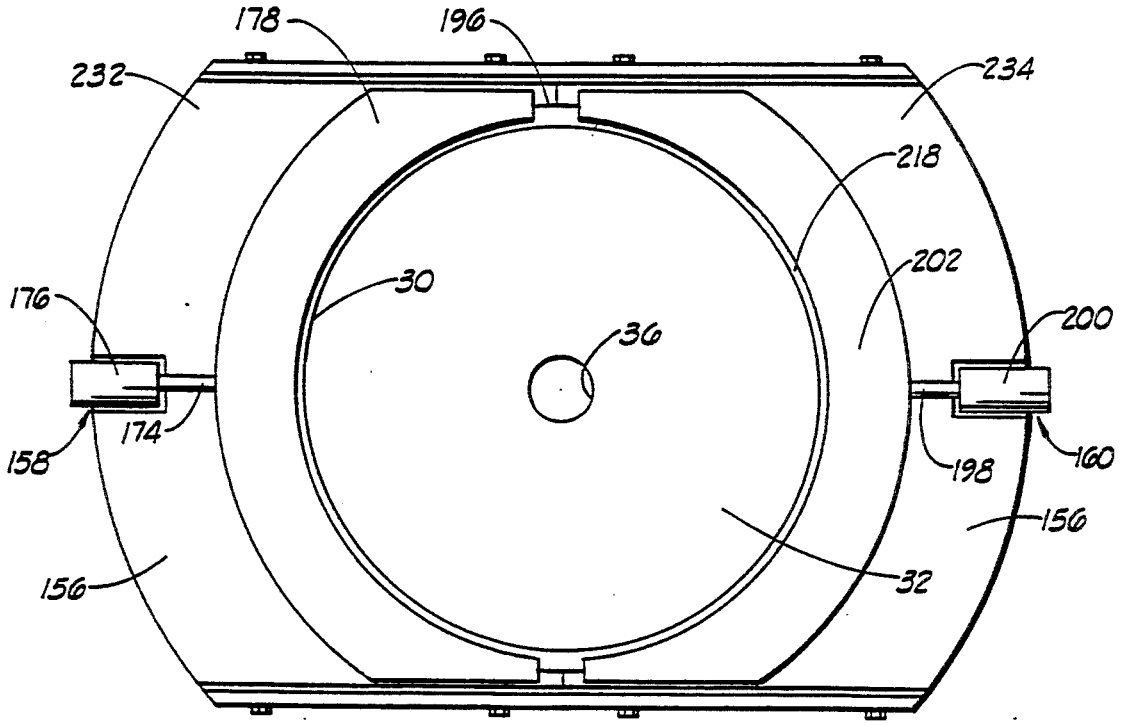
Figure 4A:
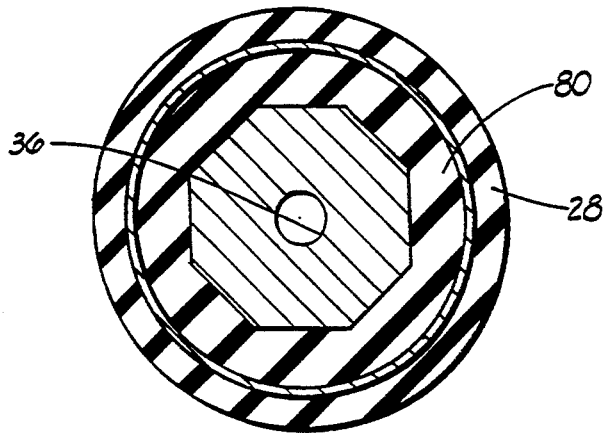
FIG. 4*a* is a plan view of the insert in the elastomeric member shown in section with the elastomeric member removed from the upper portion of the insert.

A cylindrically shaped portion 44 (FIGS. 1 and 4) of the elastomeric member 28 is generally cylindrically shaped forming a flat, substantially vertically extending outer peripheral surface 46 (FIGS. 1 and 4). The cylindrically shaped portion 44 has an upper end corresponding to the upper end 32. The cylindrically shaped portion 44 extends from the upper end 32 of the elastomeric member 28 a distance generally toward the lower end 34 terminating with a lower end 48 (FIGS. 1 and 4) of the cylindrically shaped portion 44.

A sealing flange 50 (FIGS. 1 and 4) extends from the lower end 48 of the cylindrically shaped portion 44 a distance at an angle tapered inwardly toward the drive opening 36 of the elastomeric member 28. The sealing flange 50 extends circumferentially about the elastomeric member 28.

An annular lower seal member 52 (FIGS. 1 and 4) is formed on a lower end 54 (FIGS. 1 and 4) of the sealing flange 50. The lower seal member 52 extends radially outwardly from the sealing flange 50 and circumferentially about the elastomeric member 28.

An annular upper seal member 49 (FIGS. 1 and 4) is formed on the upper end of the sealing flange 50 generally adjacent the lower end 48 of the cylindrically shaped portion 44. The upper seal member 49 extends radially outwardly from the sealing flange 50 and circumferentially about the elastomeric member 28 so that the upper seal member 49 extends outwardly and downwardly from the sealing flange 50.

The tapered inwardly portion of the sealing flange 50 provides an outer peripheral surface 57 (FIG. 4). A pair of grooves 58 and 60 (FIGS. 1 and 4) are formed in an outer peripheral surface 57 of the sealing flange 50 and each of the grooves 58 and 60 extends circumferentially about the sealing flange 50.

A portion 62 (FIG. 4) of the elastomeric member 28 extends from about the sealing flange 50 toward the lower end 18 of the elastomeric member 28 and this portion 62 is tapered inwardly generally toward the drive opening 36. The portion 62 tapers inwardly toward the drive opening 36 terminating with a cylindrically shaped portion 64 (FIG. 4) which extends from the tapered portion 62 to the lower end 34 of the elastomeric member 28.

In a preferred form, the elastomeric member 28 is constructed of a single compound rubber having a hardness of about sixty Shore D. This is a relatively soft rubber composition and is suitable particularly for making the seals required of the elastomeric member 28. However, it has been found that, in some applications, additional rigidity is required for the bearing support functions of the elastomeric member 28. A circularly shaped metal insert 80 (FIGS. 1 and 4) is disposed in the elastomeric member 28 near the upper end 32 thereof. More particularly, the insert 80 is disposed about and encompasses the cylindrically shaped portion 44 of the elastomeric member 28 to provide additional rigidity to the cylindrically shaped portion 44. In some applications, the elastomeric member 28 may include other support means, other than the insert 80, disposed in the elastomeric member 28 if desired in a particular applications. In any event, the insert 80 or the other support means is an integral part of the elastomeric member 28 and the rotating assembly 14 still consists solely of the elastomeric member 28 even though the elastomeric member 28 includes support means such as the insert 80.

An annular tapered upper bearing wall 88 (FIGS. 1 and 4) is formed on the upper end 32 of the elastomeric member 28. The tapered upper bearing wall 88 intersects the upper end 32 and intersects a portion of the outer peripheral surface 46. A tapered lower bearing wall 90 (FIGS. 1 and 4) is formed on the lower end 48 of the cylindrically shaped portion 44. The tapered upper and the lower bearing walls 88 and 90 each extend circumferentially about the elastomeric member 28.

A circularly shaped recess 116 (FIG. 1) is formed in the upper end 32 of the outer bowl 12. The recess 116 extends a distance through the outer bowl 12 toward the lower end 34 of the outer bowl 12 terminating with a lower edge 118 (FIG. 1) and forming an inner peripheral surface 120 (FIG. 1).

A wear insert 122 (FIG. 1) is disposed generally within the recess 116. The wear insert 122 is cylindrically shaped. The wear insert 122 has an upper end 124 (FIG. 1), a lower end 126 (FIG. 1), an outer peripheral surface 128 (FIG. 1) and an inner peripheral surface 130 (FIG. 1). A portion 132 (FIG. 1) of the inner peripheral surface 130 is vertically oriented and extends from the upper end 124 a distance generally toward the lower end 126 terminating with a lower end 134 (FIG. 1) of the portion 132. The inner peripheral surface 130 also includes a tapered portion 136 (FIG. 1) which extends from the lower end 134 of the portion 132 at an angle inwardly terminating with the lower end 126 of the wear insert 122.

A first annular recess 138 (FIG. 1) is formed in the outer peripheral surface 128 of the wear inset 122 forming a first water cooling space 139 (FIG. 1). A second annular recess 140 (FIG. 1) is formed in the outer peripheral surface 128 of the wear insert 122 forming a second water cooling space 141 (FIG. 1).

A water inlet 142 is formed in the outer bowl 12 in communication with the first water cooling space 139. A water outlet 143 is formed through the outer bowl 12 in communication with the second water cooling space 141.

A pair of openings 144 and 146 (FIG. 1) is formed through the outer bowl 12. Each of the openings 144 and 146 intersects the outer peripheral surface of the outer bowl 12 and the inner peripheral surface 120 formed by the recess 116. The openings 144 and 146 are in fluidic communication with respective openings in the wear insert 122.

A bearing surface 148 (FIG. 1) is formed on the inner peripheral surface 130 of the wear insert 122. The bearing surface 148 is angled outwardly and downwardly with respect to the outer peripheral surface 128. The bearing surface 148 bearingly engages the lower bearing wall 90 on the elastomeric member 28.

An annular seal recess 149 (FIG. 1) is formed in the inner peripheral surface 130 of the wear insert 122. The upper seal member 49 is disposed in the seal recess 149 in the wear insert 122.

An upper O-ring seal member 150 (FIG. 1) is disposed between the outer peripheral surface 128 of the wear insert 122 generally near the upper end 124 of the wear insert 122 and the inner peripheral surface 120 formed by the recess 116 in the outer bowl 12. A lower O-ring seal member 152 (FIG. 1) is disposed between the lower end 126 of the wear insert 122 and the lower edge 118 formed by the recess 116 in the outer bowl 12. The O-rings 150 and 152 form seals between the wear insert 122 and the outer bowl 12.

In operation, lubricant (grease) is inserted through the openings 144 and 146 for providing lubricant between the elastomeric member 28 and the wear insert 122. Water is inserted or passed into the water spaces 139 and 141 to provide cooling.

As shown in FIGS. 1 and 2, a cylindrically shaped clamp housing 156 is secured to the upper end 16 of the outer bowl 12. Portions of the clamp housing 156 extend a distance radially outwardly from the outer peripheral surface of the outer bowl 12. The clamp housing 156 is secured to the upper end 16 of the outer bowl 12 via a plurality of bolts 157 (only some of the bolts 157 being shown in FIG. 2).

As shown in FIGS. 1 and 2, the rotating head 10 includes a pair of clamp means 158 and 160. The clamp means 158 and 160 are disposed generally on opposite sides of the outer bowl 12 about 180° apart. The clamp means 158 and 160 are identical in construction and operation.

A circularly shaped recess 162 (FIG. 1) is formed through a lower surface 164 (FIGS. 1 and 2) of the clamp housing 156. The recess 162 extends a distance from the lower surface 164 toward an upper surface 166 (FIGS. 1 and 2). The recess 162 has a diameter slightly larger than the diameter of the cylindrically shaped portion 44 of the elastomeric member 28. A portion of the cylindrically shaped portion 44 of the elastomeric member 28 is disposed in the recess 162 in the clamp housing 156.

A first clamp opening 168 (FIG. 1) is formed through the clamp housing 156 with the first opening 168 intersecting an outer peripheral surface of the clamp housing 156. The first clamp opening 168 extends through the clamp housing 156 and intersects the recess 162.

A second clamp opening 172 (FIG. 1) is formed through the clamp housing 156. The second clamp opening 172 intersects the outer peripheral surface of the clamp housing 156. The second clamp opening 172 extends through the clamp housing 156 and intersects the recess 162. The first clamp opening 168 is spaced about 180° from the second clamp opening 172.

As shown in FIGS. 1 and 5, a first rod 174 is disposed in the clamp opening 168 of the clamp housing 156. One end of the first rod 174 is connected to a first air operated cylinder 176.

A first semi-circular bearing plate 178 (FIGS. 1 and 5) is connected to the first rod 174. An angled edge 196 (FIG. 1) is formed on the bearing plate 178. The angled edge 196 forms a bearing surface in the bearing plate 178 which is shaped and positioned to bearingly engage a portion of the upper bearing wall 88 formed on the upper end 32 of the elastomeric member 28.

A second rod 198 (FIGS. 1 and 5) is disposed in the second opening 172 of the clamp housing 156. One end of the second rod 198 is connected to a second air operated cylinder 200 (FIGS. 1 and 5).

A second semi-circular bearing plate 202 (FIGS. 1 and 5) is connected to the second rod 198. An angled edge 218 (FIG. 1) is formed on the second rod 198. The angled edge 218 forms a bearing surface and is shaped and positioned to bearingly engage a portion of the upper bearing wall 88 formed on the upper end 32 of the elastomeric member 28.

Figure 6:
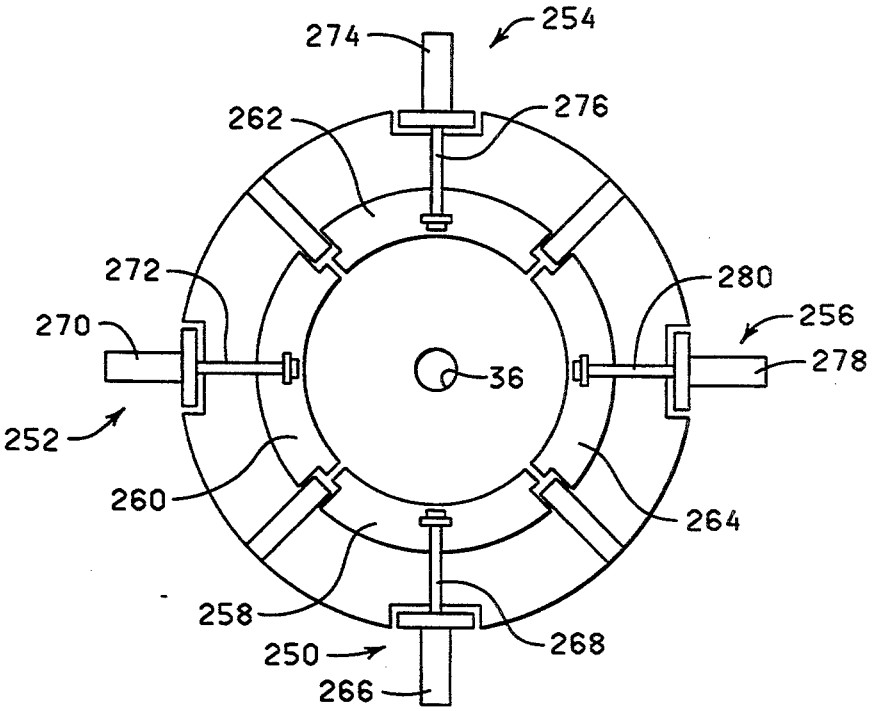
FIG. 6 is a top plan view similar to FIG. 5, but showing a modified rotating with the upper housing plate removed.

In lieu of the rotating head 10 having two clamp means 158, 160 and two semi-circular bearing plates 178, 202, as shown in FIG. 5, a rotating head having four clamp means 250, 252, 254, and 256, and four bearing plates, 258, 260, 262 and 264 as shown in the embodiment of FIG. 6 may be utilized. The bearing plates 258, 260, 262 and 264 are disposed such that each of the bearing plates 258, 260, 262 and 264 is positioned about 90° from the adjacent bearing plates.

The clamp means 250, 252, 254 and 256 are similar in construction to the clamp means 158, 160, with the exceptions noted above. Thus, the bearing plate 258 is connected to an air operated cylinder 266 via rod 268; bearing plate 260 is connected to an air operated cylinder 270 via rod 272; bearing plate 262 is connected to an air operated cylinder 274 via rod 276; and bearing plate 264 is connected to an air operated cylinder 278 via rod 280.

The clamp housing 156 more particularly comprises an upper housing plate 230 (FIGS. 1 and 5) and a pair of lower housing plate 232 and 234 (FIG. 5).

The clamp housing 156 is removed from the outer bowl 12. Then, the rotating assembly 14 is disposed in the bowl opening 13 to a position wherein the lower bearing wall 90 on the elastomeric member 28 engages the bearing surface 148 formed on the wear insert 122. In this position, the upper seal member 49 on the sealing flange 50 is disposed in the a annular seal recess 149 and sealingly engages the wear insert 122 and the lower seal member 52 engages the lower end 126 of the wear insert 122.

The clamp housing 156 then is connected to the upper end 16 of the outer bowl 12. The first and the second rods 174 and 198 initially are positioned so that the first and the second rods 174 and 198 have been moved in respective directions 194 and 216 to a position wherein the bearing surfaces formed by the angled edges 196 and 218 on the respective bearing plates 178 and 202 each are spaced a distance from the recess 162. After the clamp housing 156 has been secured to the upper end 16 of the outer bowl 12, the cylinders 176 and 200 are actuated to move the first and the second rods 174 and 198 in the respective directions 192 and 214 to a position wherein the bearing surface formed by the angled edge 196 on the bearing plate 178 engages the upper bearing wall 88 on the elastomeric member 28 and the bearing surface 218 on the bearing plate 202 engages a portion of the upper bearing wall 88 on the elastomeric member 28. The rotating assembly 14 is bearingly supported in the outer bowl 12 via the tapered upper and the lower bearing walls 88 and 90 formed on the elastomeric member 28 and the bearing surface 148 formed on the wear insert 122 and the angled edges 196 and 218 on the first and the second rods 174 and 198. As the bearing surfaces 88, 90, 196, 218 and 148 wear, the first and the second rods 174 and 198 can be adjusted inwardly and outwardly to provide the proper bearing engagement.

When the drill pipe 38 is drivingly rotated, the elastomeric member 28 is drivingly rotated due to the gripping engagement between the elastomeric member 28 and the drill pipe 38. As the rotating assembly 14 rotates, upper seal member 49 and the lower seal member 52 sealing engage the wear insert 122 for providing sealing engagement between the rotating assembly 14 and the outer bowl 12.

If the rotating bushing 30 or the elastomeric member 28 becomes worn or otherwise in need of repair or replacement, the clamp housing 156 is unbolted and remove from the outer bowl 12. In this position of the clamp housing 156, the elastomeric member 28 is removed from the bowl opening 13. After removal of the elastomeric member 28, a new or repaired elastomeric member 28 then can be installed in the bowl opening 13 and the clamp housing 156 then can be reassembled to the outer bowl 12. The replacement of the elastomeric member 28 replaces the bearing and the sealing members.

Figure 7:
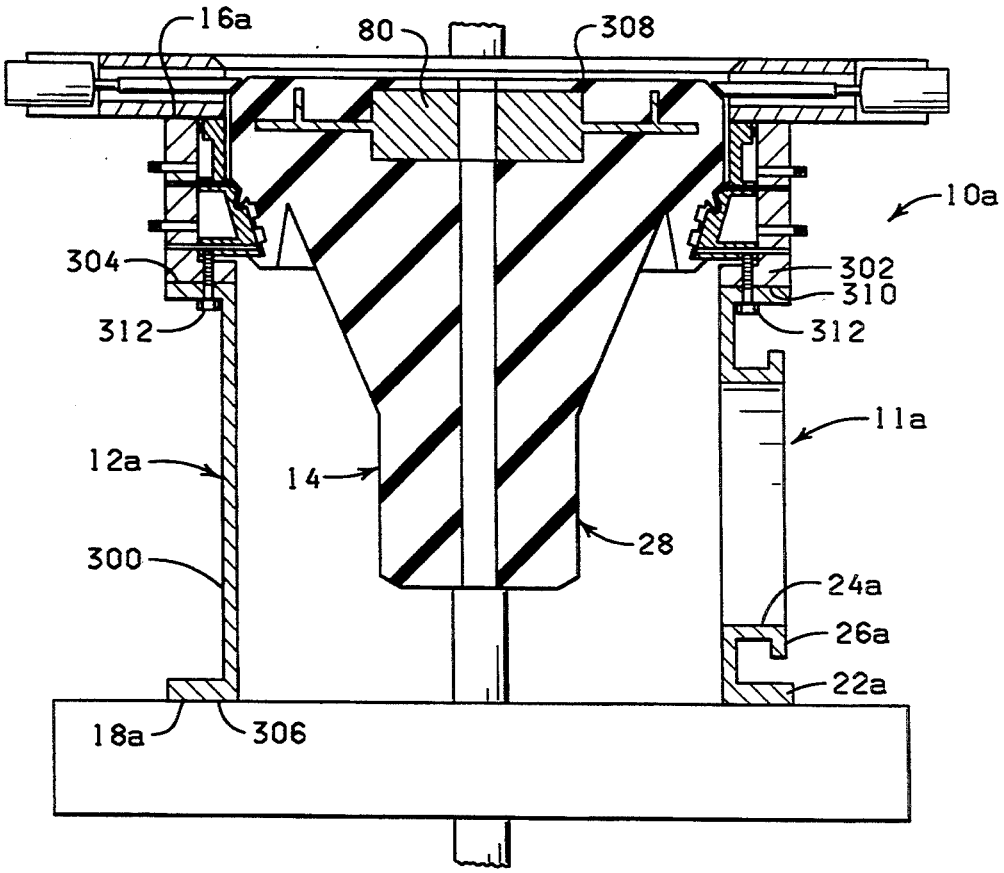
FIG. 7 is a sectional view of a modified rotating head.

Embodiment of FIG. 7

Shown in FIG. 7 is a rotating head 10*a* which is constructed exactly like the rotating head 10 described in detail before, except the rotating 10*a* includes a modified bowl assembly 11*a*. The modified bowl assembly of 11*a* includes a lower bowl 300 and an upper bowl 302.

The lower bowl 300 has an upper end 304 and a lower end 306. A portion of the bowl opening 13*a* is formed through the lower bowl 300 intersecting the upper end 304 and the lower end 306 of the lower bowl 300. A discharge opening 24*a* is formed through the lower bowl 300.

The upper bowl 302 has an upper end 308 and a lower end 310. A portion of a bowl opening 13*a* is formed through the upper bowl 302 intersecting the upper and the lower end 308 and 310 thereof. The upper bowl 302 is connected to the lower bowl 300 by way of a plurality of bolts 312 (only two bolts 312 being shown in FIG. 7). In the assembled position of the lower bowl 300 and the upper bowl 302, the bowl openings in the lower bowl 300 and the upper bowl 302 cooperate to form the bowl opening 13 in the bowl assembly 11*a*. The rotating assembly 14 is constructed exactly like the rotating assembly described in detail before and the rotating assembly 14 is supported within the upper bowl 302.

Utilizing the construction of the bowl assembly 11*a* shown in FIG. 7, the lower bowl 300 can be removed and interchanged with a lower bowl 300 of a different size to fit different blow-out preventers without the necessity of having to purchase an entire new bowl assembly.

Changes may be made in the construction and the operation of the various components, elements and assemblies described herein without departing from the spirit and scope of the invention as defined in the following claims.

What is claimed is:

1. A rotating head adapted for use in drilling a well borehole at a well drilling site wherein drilling fluid is passed into the well borehole and wherein some of the drilling fluid is passed from the well borehole and wherein a rotatable drill pipe extends into the well borehole during the drilling operation, comprising:

a bowl assembly having a bowl opening and a discharge opening, the bowl assembly being adapted to receive drilling fluid into the bowl opening and pass the drilling fluid through the discharge opening; and a rotating assembly disposed in the bowl opening consisting of:

an elastomeric member having an upper end, a lower end, and elastomeric member outer peripheral surface, a drive opening extending through the elastomeric member intersecting the upper end and the lower end of the elastomeric member and a cylindrically shaped portion extending from the upper end of the elastomeric member a distance toward the lower end of the elastomeric member terminating with a lower end of the cylindrically shaped portion and having a substantially flat, vertically extending outer peripheral surface forming a portion of the elastomeric member outer peripheral surface, the elastomeric member being disposed in the bowl opening in an operating position, a portion of the elastomeric member defining sealing means for providing sealing engagement between the bowl assembly and a portion of the elastomeric member, the sealing means of the elastomeric member comprising a seal flange formed on the elastomeric member, the seal flange having an outer peripheral surface tapered inwardly toward the drive bore in the elastomeric member, the seal flange extending from the lower end of the cylindrically shaped portion of the elastomeric member a distance toward the lower end of the elastomeric member and forming a portion of the outer peripheral surface of the elastomeric member, the outer peripheral surface of the seal flange sealingly engaging a portion of the bowl assembly so as to form the seal between the rotating assembly and the bowl assembly, the seal flange further comprising an annular seal member formed on the outer peripheral surface of the seal flange near a lower end thereof, the annular seal member engaging a portion of the bowl assembly, the elastomeric member further defining bearing wall means for bearingly engaging the bowl assembly and for rotatingly supporting the rotating assembly in the bowl opening, the bearing wall means of the elastomeric member comprising a tapered lower bearing wall formed on the cylindrically shaped portion of the elastomeric member near the lower end of the cylindrically shaped portion, the lower bearing wall intersecting the vertically extending outer peripheral surface of the cylindrically shaped portion and the lower bearing wall extending circumferentially about the elastomeric member and a tapered upper bearing wall formed on the upper end of the elastomeric member intersecting the vertically extending outer peripheral surface of the cylindrically shaped portion with the upper bearing wall extending circumferentially about the elastomeric member, the upper bearing wall and the lower bearing wall each bearingly engaging a portion of the bowl assembly for bearingly supporting the elastomeric member in the bowl assembly, the drill pipe being extendable through the drive opening in the elastomeric member and the elastomeric member grippingly engaging the drill pipe, and the rotating of the drill pipe causing the rotating of the rotating assembly due to the gripping engagement between the elastomeric member and the drill pipe.

2. The rotating head of claim 1 wherein the bowl assembly is provided with a water inlet and a water outlet and wherein the bowl assembly further comprises:

a wear insert disposed in the bowl assembly, the wear insert having an upper end, a lower end, an inner peripheral surface and an outer peripheral surface, a portion of the inner peripheral surface of the wear insert sealingly engaging a portion of the seal flange of the elastomeric member, a portion of the outer peripheral surface of the wear insert having an annular recess formed therein so as to form a water cooling space, the water cooling space being in fluidic communication with the water inlet and the water outlet so that water can be circulated through the water cooling space.

3. The rotating head of claim 1 wherein the bowl assembly is provided with a water inlet and a water outlet and wherein the bowl assembly further comprises:

a wear insert disposed in the bowl assembly, the wear insert having an upper end, a lower end, an inner peripheral surface and an outer peripheral surface, a portion of the inner peripheral surface of the wear insert sealingly engaging a portion of the seal flange of the elastomeric member, a portion of the outer peripheral surface of the wear insert-having a first annular recess formed therein so as to form a first water cooling space and a portion of the outer peripheral surface of the wear insert having a second annular recess formed therein so as to form a second water cooling space which is in fluidic communication with the first water cooling space, the first water cooling space being in fluidic communication with the water inlet and the second water cooling space being in fluidic communication with the water outlet so that water can be circulated through the first and second cooling spaces to provide cooling to the wear insert.

4. The rotating head of claim 3 wherein the elastomeric member is further defined as being constructed of an elastomeric material having a consistent hardness throughout and wherein the elastomeric member further comprises reinforcing means disposed in the elastomeric member generally about the cylindrically shaped portion for reinforcing the upper bearing wall and the lower bearing wall.

5. The rotating head of claim 4 wherein the elastomeric member is constructed of the elastomeric material having a hardness of about sixty Shore D.

6. The rotating head of claim 3 wherein the elastomeric member is further defined as being constructed of an elastomeric material having a consistent hardness throughout and wherein the elastomeric member further comprises reinforcing means disposed in the elastomeric member generally about the cylindrically shaped portion for reinforcing the upper bearing wall and the lower bearing wall.

7. The rotating head of claim 6 wherein the elastomeric member is constructed of the elastomeric material having a hardness of about sixty Shore D.

8. A rotating head adapted for use in drilling a well borehole at a well drilling site wherein drilling fluid is passed into the well borehole and wherein some of the drilling fluid is passed from the well borehole and wherein a rotatable drill pipe extends into the well borehole during the drilling operation, comprising:

a bowl assembly having a bowl opening and a discharge opening, the bowl assembly being adapted to receive drilling fluid into the bowl opening and pass the drilling fluid through the discharge opening; and a rotating assembly disposed in the bowl opening consisting of:

an elastomeric member having an upper end, a lower end, an elastomeric member outer peripheral surface and a drive opening extending through the elastomeric member intersecting the upper end and the lower end of the elastomeric member, the elastomeric member being disposed in the bowl opening in an operating position, a portion of the elastomeric member defining sealing means for providing sealing engagement between the bowl assembly and a portion of the elastomeric member, the sealing means of the elastomeric member comprising a seal flange formed on the elastomeric member, the seal flange having an outer peripheral surface tapered inwardly toward the drive bore in the elastomeric member, the seal flange extending from the lower end of a cylindrically shaped portion of the elastomeric member a distance toward the lower end of the elastomeric member, the outer peripheral surface of the seal flange sealingly engaging a portion of the bowl assembly so as to form the seal between the rotating assembly and the bowl assembly, the outer peripheral surface of the seal flange forming a portion of the outer peripheral surface of the elastomeric member, the seal flange further comprising an annular seal member formed on the outer peripheral surface of the seal flange, near a lower end thereof, the annular seal member engaging a portion of the bowl assembly, the elastomeric member further defining bearing wall means for bearingly engaging the bowl assembly and for rotatingly supporting the rotating assembly in the bowl opening, the drill pipe being extendable through the drive opening in the elastomeric member and the elastomeric member grippingly engaging the drill pipe, and the rotating of the drill pipe causing the rotating of the rotating assembly due to the gripping engagement between the elastomeric member and the drill pipe.

9. The rotating head of claim 8 wherein the bowl assembly is provided with a water inlet and a water outlet and wherein the bowl assembly further comprises:

a wear insert disposed in the bowl assembly, the wear insert having an upper end, a lower end, an inner peripheral surface and an outer peripheral surface, a portion of the inner peripheral surface of the wear insert sealingly engaging a portion of the seal flange of the elastomeric member, a portion of the outer peripheral surface of the wear insert having an annular recess formed therein so as to form a water cooling space, the water cooling space being in fluidic communication with the water inlet and the water outlet so that water can be circulated through the water cooling space.

10. The rotating head of claim 9 wherein the elastomeric member is further defined as being constructed of an elastomeric material having a consistent hardness throughout and wherein the elastomeric member further comprises reinforcing means disposed in the elastomeric member generally about the cylindrically shaped portion for reinforcing an upper bearing wall and a lower bearing wall.

11. The rotating head of claim 10 wherein the elastomeric member is constructed of the elastomeric material having a hardness of about sixty Shore D.

12. The rotating head of claim 8 wherein the bowl assembly is provided with a water inlet and a water outlet and wherein the bowl assembly further comprises:

a wear insert disposed in the bowl assembly, the wear insert having an upper end, a lower end, an inner peripheral surface and an outer peripheral surface, a portion of the inner peripheral surface of the wear insert sealingly engaging a portion of the seal flange of the elastomeric member, a portion of the outer peripheral surface of the wear insert having a first annular recess formed therein so as to form a first water cooling space and a portion of the outer peripheral surface of the wear insert having a second annular recess formed therein so as to form a second water cooling space which is in fluidic communication with the first water cooling space, the first water cooling space being in fluidic communication with the water inlet and the second water cooling space being in fluidic communication with the water outlet so that water can be circulated through the first and second cooling spaces to provide cooling to the wear insert.

13. The rotating head of claim 12 wherein the elastomeric member is further defined as being constructed of an elastomeric material having a consistent hardness throughout and wherein the elastomeric member further comprises reinforcing means disposed in the elastomeric member generally about the cylindrically shaped portion for reinforcing an upper bearing wall and a lower bearing wall.

14. The rotating head of claim 13 wherein the elastomeric member is constructed of the elastomeric material having a hardness of about sixty Shore D.

15. A rotating head adapted for use in drilling a well borehole at a well drilling site wherein drilling fluid is passed into the well borehole and wherein some of the drilling fluid is passed from the well borehole and wherein a rotatable drill pipe extends into the well borehole during the drilling operation, comprising:

a bowl assembly having a bowl opening, a discharge opening, a water inlet and a water outlet, the bowl assembly being adapted to receive drilling fluid into the bowl opening and pass the drilling fluid through the discharge opening, and wherein the bowl assembly further comprises:

a wear insert disposed in the bowl assembly, the wear insert having an upper end, a lower end, an inner peripheral surface and an outer peripheral surface, a portion of the outer peripheral surface of the wear insert having at least one annular recess formed therein so as to form a water cooling space, the water cooling space being in fluidic communication with the water inlet and the water outlet so that water can be circulated through the water cooling space; and a rotating assembly disposed in the bowl opening consisting of:

an elastomeric member having an upper end, a lower end, an elastomeric member outer peripheral surface, and a drive opening extending through the elastomeric member intersecting the upper end and the lower end of the elastomeric member, the elastomeric member being disposed in the bowl opening in an operating position, a portion of the elastomeric member defining sealing means for providing sealing engagement between the bowl assembly and a portion of the elastomeric member, the elastomeric member further defining bearing wall means for bearingly engaging the bowl assembly and for rotatingly supporting the rotating assembly in the bowl opening, the drill pipe being extendable through the drive opening in the elastomeric member and the elastomeric member grippingly engaging the drill pipe, and the rotating of the drill pipe causing the rotating of the rotating assembly due to the gripping engagement between the elastomeric member and the drill pipe.

16. The rotating head of claim 15 wherein the portion of the outer peripheral surface of the wear insert defining the water cooling space is provided with a first annular recess formed therein so as to form a first water cooling space and a portion of the outer peripheral surface of the wear insert is further provided with a second annular recess formed therein so as to form a .second water cooling space which is in fluidic communication with the first water cooling space, the first water cooling space being in fluidic communication with the water inlet and the second water cooling space being in fluidic communication with the water outlet so that water can be circulated through the first and second cooling spaces to provide cooling to the wear insert.

17. The rotating head of claim 16 wherein the elastomeric member is defined further to comprise a cylindrically shaped portion extending from the upper end of the elastomeric member a distance toward the lower end of the elastomeric member terminating with a lower end of the cylindrically shaped portion and having a substantially flat, vertically extending outer peripheral surface forming a portion of the elastomeric outer peripheral surface, and wherein the bearing wall means of the elastomeric member comprises:

a tapered lower bearing wall formed on the cylindrically shaped portion of the elastomeric member near the lower end of the cylindrically shaped portion, the lower bearing wall intersecting the vertically extending outer peripheral surface of the cylindrically shaped portion and the lower bearing wall extending circumferentially about the elastomeric member; and a tapered upper bearing wall formed on the upper end of the elastomeric member intersecting the vertically extending outer peripheral surface of the cylindrically shaped portion with the upper bearing wall extending circumferentially about the elastomeric member, and the upper bearing wall and the lower bearing wall each bearingly engaging a portion of the bowl assembly for bearingly supporting the elastomeric member in the bowl assembly.

18. The rotating head of claim 17 wherein the sealing means of the elastomeric member comprises a seal flange formed on the elastomeric member having an outer peripheral surface tapered inwardly toward the drive opening in the elastomeric member, the seal flange extending from the lower end of the cylindrically shaped portion of the elastomeric member, the outer peripheral surface of the seal flange sealingly engaging a portion of the bowl assembly so as to form the seal between the rotating assembly and the bowl assembly, the outer peripheral surface of the seal flange forming a portion of the outer peripheral surface of the elastomeric member.

19. The rotating head of claim 18 wherein the seal flange further comprises an annular upper seal member formed on the outer peripheral surface of the seal flange with the upper seal member extending a distance from the outer peripheral surface of the seal flange, and the upper seal member sealingly engaging a portion of the bowl assembly.

20. The rotating head of claim 19 wherein the seal flange further comprises an annular lower seal member formed on the outer peripheral surface of the seal flange, the lower seal member sealingly engaging a portion of the bowl assembly.

21. A rotating head adapted for use in drilling a well borehole at a well drilling site wherein drilling fluid is passed into the well borehole and wherein some of the drilling fluid is passed from the well borehole and wherein a rotatable drill pipe extends into the well borehole during the drilling operation, comprising:

a bowl assembly having a bowl opening and a discharge opening, the bowl assembly being adapted to receive drilling fluid into the bowl opening and pass the drilling fluid through the discharge opening, the bowl opening having a wear insert disposed therein; and a rotating assembly disposed in the bowl opening consisting of:

an elastomeric member having an upper end, a lower end, an elastomeric member outer peripheral surface, a drive opening extending through the elastomeric member intersecting the upper end and the lower end of the elastomeric member and a cylindrically shaped portion extending from the upper end of the elastomeric member a distance toward the lower end of the elastomeric member terminating with a lower end of the cylindrically shaped portion and having a substantially flat, vertically extending outer peripheral surface forming a portion of the elastomeric member outer peripheral surface, the elastomeric member being disposed in the bowl opening in an operating position, a portion of the elastomeric member defining sealing means for providing sealing engagement between the bowl assembly and a portion of the elastomeric member, the sealing means of the elastomeric member comprising a seal flange formed on the elastomeric member, the seal flange having an outer peripheral surface tapered inwardly toward the drive opening in the elastomeric member, the seal flange extending from the lower end of the cylindrically shaped portion of the elastomeric member a distance toward the lower end of the elastomeric member and forming a portion of the outer peripheral surface of the elastomeric member, the outer peripheral surface of the seal flange sealingly engaging a portion of the bowl assembly so as to form the seal between the rotating assembly and the bowl assembly, the seal flange further comprising an annular seal member formed on the outer peripheral surface of the seal flange near a lower end thereof, the annular seal member engaging a portion of the bowl assembly, the elastomeric member further defining bearing wall means for bearingly engaging the bowl assembly and for rotatingly supporting the rotating assembly in the bowl opening, the bearing wall means of the elastomeric member comprising a tapered lower bearing wall formed on the cylindrically shaped portion of the elastomeric member near the lower end of the cylindrically shaped portion, the lower bearing wall intersecting the vertically extending outer peripheral surface of the cylindrically shaped portion and the lower bearing wall extending circumferentially about the elastomeric member and a tapered upper bearing wall formed on the upper end of the elastomeric member intersecting the vertically extending outer peripheral surface of the cylindrically shaped portion with the upper bearing wall extending circumferentially about the elastomeric member, the upper bearing wall and the lower bearing wall each bearingly engaging a portion of the bowl assembly for bearingly supporting the elastomeric member in the bowl assembly, and wherein the drill pipe being extendable through the drive opening in the elastomeric member and the elastomeric member grippingly engaging the drill pipe, and the rotating of the drill pipe causing the rotating of the rotating assembly due to the gripping engagement between the elastomeric member and the drill pipe; wherein the bowl assembly further comprises:

a clamp housing having an upper surface, a lower surface and an outer peripheral surface, a recess being formed in the lower surface of the clamp housing, the upper end of the rotating assembly being disposed in the recess in the clamp housing, at least one clamp opening being formed through the clamp housing intersecting the outer peripheral surface and the recess in the clamp housing;

a rod having a first end and a second end disposed in the clamp opening;

a bearing plate connected to the second end of the rod, the bearing plate having an angled edge formed thereon forming a bearing surface; and wherein the wear insert is defined further to comprise a bearing surface formed on a portion thereof, the bearing surface on the wear insert being bearingly engageable with the tapered lower bearing wall, and pneumatic cylinder means for moving the rod in the clamp opening to one position wherein the bearing surface on the bearing plate bearingly engages the bearing surface on the tapered upper bearing wall and for moving the rod in the clamp opening to one other position wherein the bearing surface on the bearing plate is spaced a distance from the bearing surface on the tapered upper bearing wall, the rod being movable in the clamp opening for adjusting the position of the bearing surface on the bearing plate with respect to the bearing surface on the tapered upper bearing wall of the elastomeric member.

22. A rotating head adapted for use in drilling a well borehole at a well drilling site wherein drilling fluid is passed into the well borehole and wherein some of the drilling fluid is passed from the well borehole and wherein a rotatable drill pipe extends into the well borehole during the drilling operation, comprising:

a bowl assembly having a bowl opening and a discharge opening, the bowl assembly being adapted to receive drilling fluid into the bowl opening and pass the drilling fluid through the discharge opening; and a rotating assembly disposed in the bowl opening consisting of:

an elastomeric member having an upper end, a lower end, an elastomeric member outer peripheral surface, a drive opening extending through the elastomeric member intersecting the upper end and the lower end of the elastomeric member and a cylindrically shaped portion extending from the upper end of the elastomeric member a distance toward the lower end of the elastomeric member terminating with a lower end of the cylindrically shaped portion and having a substantially flat, vertically extending outer peripheral surface forming a portion of the elastomeric member outer peripheral surface, the elastomeric member being disposed in the bowl opening in an operating position, a portion of the elastomeric member defining sealing means for providing sealing engagement between the bowl assembly and a portion of the elastomeric member, the sealing means of the elastomeric member comprising a seal flange formed on the elastomeric member, the seal flange having an outer peripheral surface tapered inwardly toward the drive opening in the elastomeric member, the seal flange extending from the lower end of the cylindrically shaped portion of the elastomeric member a distance toward the lower end of the elastomeric member and forming a portion of the outer peripheral surface of the elastomeric member, the outer peripheral surface of the seal flange sealingly engaging a portion of the bowl assembly so as to form the seal between the rotating assembly and the bowl assembly, the seal flange further comprising an annular seal member formed on the outer peripheral surface of the seal flange near a lower end thereof, the annular seal member engaging a portion of the bowl assembly, the elastomeric member further defining bearing wall means for bearingly engaging the bowl assembly and for rotatingly supporting the rotating assembly in the bowl opening, the bearing wall means of the elastomeric member comprising a tapered lower bearing wall formed on the cylindrically shaped portion of the elastomeric member near the lower end of the cylindrically shaped portion, the lower bearing wall intersecting the vertically extending outer peripheral surface of the cylindrically shaped portion and the lower bearing wall extending circumferentially about the elastomeric member and a tapered upper bearing wall formed on the upper end of the elastomeric member intersecting the vertically extending outer peripheral surface of the cylindrically shaped portion with the upper bearing wall extending circumferentially about the elastomeric member, the upper bearing wall and the lower bearing wall each bearingly engaging a portion of the bowl assembly for bearingly supporting the elastomeric member in the bowl assembly, and wherein the drill pipe being extendable through the drive opening in the elastomeric member and the elastomeric member grippingly engaging the drill pipe, and the rotating of the drill pipe causing the rotating of the rotating assembly due to the gripping engagement between the elastomeric member and the drill pipe;

wherein the bowl assembly further comprises:

a clamp housing having an upper surface, a lower surface and an outer peripheral surface, a recess being formed in the lower surface of the clamp housing, the upper end of the rotating assembly being disposed in the recess in the clamp housing, a first clamp opening being formed through the clamp housing intersecting the outer peripheral surface and the recess in the clamp housing, and a second clamp opening being formed through the clamp housing intersecting the outer peripheral surface and the recess in the clamp housing, the first clamp opening being spaced about 180 degrees from the second clamp opening;

a first rod having a first end and a second end disposed in the first clamp opening;

a first bearing plate connected to the second end of the first rod, the first bearing plate having an angled edge formed thereon forming a bearing surface;

a second rod having a first end and a second end disposed in the second clamp opening;

a second bearing plate connected to the second end of the second rod, the second bearing plate having an angled edge formed thereon forming a bearing surface; and wherein the bearing surface on the first bearing plate connected to the first rod and the bearing surface on the second bearing plate connected to the second rod being bearingly engageable with the tapered upper bearing wall formed on the elastomeric member;

first pneumatic cylinder means for moving the first rod in the first clamp opening to one position wherein the bearing surface on the first bearing plate connected to the first rod bearingly engages the tapered upper bearing wall and for moving the first rod in the first clamp opening to one other position wherein the bearing surface on the first bearing plate connected to the first rod is spaced a distance from the tapered upper bearing wall, the first rod being movable in the clamp opening for adjusting the position of the bearing surface on the first bearing plate connected to the first rod with respect to the tapered upper bearing wall; and second pneumatic cylinder means for moving the second rod in the second clamp opening to one position wherein the bearing surface on the second bearing plate connected to the second rod bearingly engages the tapered upper bearing wall and for moving the second rod in the second clamp opening to one other position wherein the bearing surface on the second bearing plate connected to the second rod is spaced distance from the tapered upper bearing wall, the second rod being movable in the second clamp opening for adjusting the position of the bearing surface on the second bearing plate connected to the second rod with respect to the tapered upper bearing wall.

23. A rotating head adapted for use in drilling a well borehole at a well drilling site wherein drilling fluid is passed into the well borehole and wherein some of the drilling fluid is passed from the well borehole and wherein a rotatable drill pipe extends into the well borehole during the drilling operation, comprising:

a bowl assembly having a bowl opening and a discharge opening, the bowl assembly being adapted to receive drilling fluid into the bowl opening and pass the drilling fluid through the discharge opening; and a rotating assembly disposed in the bowl opening consisting of:

an elastomeric member having an upper end, a lower end, an elastomeric member outer peripheral surface, a drive opening extending through the elastomeric member intersecting the upper end and the lower end of the elastomeric member and a cylindrically shaped portion extending from the upper end of the elastomeric member a distance toward the lower end of the elastomeric member terminating with a lower end of the cylindrically shaped portion and having a substantially flat, vertically extending outer peripheral surface forming a portion of the elastomeric member outer peripheral surface, the elastomeric member being disposed in the bowl opening in an operating position, a portion of the elastomeric member defining sealing means for providing sealing engagement between the bowl assembly and a portion of the elastomeric member, the sealing means of the elastomeric member comprising a seal flange formed on the elastomeric member, the seal flange having an outer peripheral surface tapered inwardly toward the drive opening in the elastomeric member, the seal flange extending from the lower end of the cylindrically shaped portion of the elastomeric member a distance toward the lower end of the elastomeric member and forming a portion of the outer peripheral surface of the elastomeric member, the outer peripheral surface of the seal flange sealingly engaging a portion of the bowl assembly so as to form the seal between the rotating assembly and the bowl assembly, the seal flange further comprising an annular seal member formed on the outer peripheral surface of the seal flange near a lower end thereof, the annular seal member engaging a portion of the bowl assembly, the elastomeric member further defining bearing wall means for bearingly engaging the bowl assembly and for rotatingly supporting the rotating assembly in the bowl opening, the bearing wall means of the elastomeric member comprises a tapered lower bearing wall formed on the cylindrically shaped portion of the elastomeric member near the lower end of the cylindrically shaped portion, the lower bearing wall intersecting the vertically extending outer peripheral surface of the cylindrically shaped portion and the lower bearing wall extending circumferentially about the elastomeric member and a tapered upper bearing wall formed on the upper end of the elastomeric member intersecting the vertically extending outer peripheral surface of the cylindrically shaped portion with the upper bearing wall extending circumferentially about the elastomeric member, the upper bearing wall and the lower bearing wall each bearingly engaging a portion of the bowl assembly for bearingly supporting the elastomeric member in the bowl assembly, and wherein the drill pipe being extendable through the drive opening in the elastomeric member and the elastomeric member grippingly engaging the drill pipe, and the rotating of the drill pipe causing the rotating of the rotating assembly due to the gripping engagement between the elastomeric member and the drill pipe;

wherein the bowl assembly further comprises:

a clamp housing having an upper surface, a lower surface and an outer peripheral surface, a recess being formed in the lower surface of the clamp housing, the upper end of the rotating assembly being disposed in the recess in the clamp housing, a first clamp opening being formed through the clamp housing intersecting the outer peripheral surface and the recess in the clamp housing, a second clamp opening being formed through the clamp housing intersecting the outer peripheral surface and the recess in the clamp housing, a third clamp opening being formed through the clamp housing intersecting the outer peripheral surface and the recess in the clamp housing, and a fourth clamp opening being formed through the clamp housing intersecting the outer peripheral surface and the recess in the clamp housing, the first, second, third and fourth clamp openings being spaced about the clamp housing;

a first rod having a first end and a second end disposed in the first clamp opening;

a first bearing plate connected to the second end of the first rod, the first bearing plate having an angled edge formed thereon forming a bearing surface;

a second rod having a first end and a second end disposed in the second clamp opening;

a second bearing plate connected to the second end of the second rod, the second bearing plate having an angled edge formed thereon forming a bearing surface;

a third rod having a first end and a second end disposed in the third clamp opening;

a third bearing plate connected to the second end of the third rod, the third bearing plate having an angled edge formed thereon forming a bearing surface;

a fourth rod having a first end and a second end disposed in the fourth clamp opening;

a fourth bearing plate connected to the second end of the fourth rod, the fourth bearing plate having an angled edge formed thereon forming a bearing surface; and first pneumatic cylinder means for moving the first rod in the first clamp opening to one position wherein the bearing surface on the first bearing plate connected to the first rod bearingly engages the tapered upper bearing wall and for moving the first rod in the first clamp opening to one other position wherein the bearing surface on the first bearing plate connected to the first rod is spaced a distance from the tapered upper bearing wall, the first rod being movable in the clamp opening for adjusting the position of the bearing surface on the first bearing plate connected to the first rod with respect to the tapered upper bearing wall;

second pneumatic cylinder means for moving the second rod in the second clamp opening to one position wherein the bearing surface on the second bearing plate connected to the second rod bearingly engages the tapered upper bearing wall and for moving the second rod in the second clamp opening to one other position wherein the bearing surface on the second bearing plate connected to the second rod is spaced a distance from the tapered upper bearing wall, the second rod being movable in the second clamp opening for adjusting the position of the bearing surface on the second bearing plate connected to the second rod with respect to the tapered upper bearing wall;

third pneumatic cylinder means for moving the third rod in the third clamp opening to one position wherein the bearing surface on the third bearing plate connected to the third rod bearingly engages the tapered upper bearing wall and for moving the third rod in the third clamp opening to one other position wherein the bearing surface on the third bearing plate connected to the third rod is spaced a distance from the tapered upper bearing wall, the third rod being movable in the third clamp opening for adjusting the position of the bearing surface on the third bearing plate connected to the third rod with respect to the tapered upper bearing wall; and fourth pneumatic cylinder means for moving the fourth rod in the fourth clamp opening to one position wherein the bearing surface on the fourth bearing plate connected to the fourth rod bearingly engages the tapered upper bearing wall and for moving the fourth rod in the fourth clamp opening to one other position wherein the bearing surface on the fourth bearing plate connected to the fourth rod is spaced a distance from the tapered upper bearing wall, the fourth rod being movable in the fourth clamp opening for adjusting the position of the bearing surface on the fourth bearing plate connected to the fourth rod with respect to the tapered upper bearing wall.

* * * * *

UNITED STATES PATENT AND TRADEMARK OFFICE

CERTIFICATE OF CORRECTION

PATENT NO. : 5,409,073

DATED : April 25, 1995

INVENTOR(S) : Gonzales

It is certified that error appears in the above-indentified patent and that said Letters Patent is hereby corrected as shown below:

Column 1, line 21, please delete "rotting" and substitute therefor -- rotating --.

Column 1, line 33, after "rotating" please insert -- head --.

Column 1, line 46, please delete "." after "opening".

Column 1, line 49, please delete "." after "bearingly".

Column 2, line 60, please delete "supported" and substitute therefor -- supporting --.

Column 5, line 27, please delete "first opening 168" and substitute therefor -- first clamp opening 168 --.

Column 5, line 39, please insert "first" before "clamp opening 168".

Column 6, line 19, please delete the word "a" after "in the".

Column 6, line 56, please delete "sealing" and substitute therefor -- sealingly --.

Column 6, line 62, please delete "remove" and substitute therefor -- removed --.

Column 7, line 6, please delete "rotating 10a" and substitute therefor -- rotating head 10a --.

Column 7, line 7, please delete the word "of".

UNITED STATES PATENT AND TRADEMARK OFFICE

CERTIFICATE OF CORRECTION

PATENT NO. : 5,409,073

DATED : April 25, 1995

INVENTOR(S) : Gonzales

It is certified that error appears in the above-indentified patent and that said Letters Patent is hereby corrected as shown below:

Column 7, line 18, please delete "lower end" and substitute therefor -- lower ends --.

Column 7, lines 23-24, please delete "bowl opening 13" and substitute therefor -- bowl opening 13a --.

Column 7, line 54, please delete "and" and substitute therefor -- an --.

Column 9, line 9, please delete "-" after "insert".

Column 9, lines 22-32, please delete claims 4 and 5, which are duplicated at claims 6 and 7.

Column 12, line 8, please delete "." before "second".

Signed and Sealed this

Thirty-first Day of October 1995

*Attest:*

*Attesting Officer*

BRUCE LEHMAN

*Commissioner of Patents and Trademarks*